US010563360B2

(12) United States Patent
Bang et al.

(10) Patent No.: US 10,563,360 B2
(45) Date of Patent: Feb. 18, 2020

(54) FINGER JOINT WITH A BRIDGING COVER PLATE

(71) Applicants: KETECH CO., LTD., Daejeon (KR); R.J. Watson, Inc., Alden, NY (US)

(72) Inventors: In Seok Bang, Incheon (KR); Joon Ho Baek, Daejeon (KR)

(73) Assignees: R.J. WATSON, INC., Alden, NY (US); KETECH CO., LTD, Daejeon (KR)

( * ) Notice: Subject to any disclaimer, the term of this patent is extended or adjusted under 35 U.S.C. 154(b) by 126 days.

(21) Appl. No.: 15/875,445

(22) Filed: Jan. 19, 2018

(65) Prior Publication Data

US 2018/0209104 A1 Jul. 26, 2018

(30) Foreign Application Priority Data

Jan. 25, 2017 (KR) ..... 10-2017-0011770

(51) Int. Cl.

| | |
|---|---|
| ***E01D 19/06*** | (2006.01) |
| ***E01C 11/02*** | (2006.01) |
| ***E01D 19/04*** | (2006.01) |
| *E01D 15/00* | (2006.01) |

(52) U.S. Cl.

CPC ..... *E01C 11/02* (2013.01); *E01D 19/041* (2013.01); *E01D 19/06* (2013.01); *E01D 19/065* (2013.01); *E01D 15/005* (2013.01)

(58) Field of Classification Search

CPC ..... E04F 15/14; E01D 19/06; E01D 19/065
USPC ..... 14/73.1, 73.5
See application file for complete search history.

(56) References Cited

U.S. PATENT DOCUMENTS 4,007,994 A * 2/1977 Brown ..... E01D 19/06 404/69
4,067,155 A * 1/1978 Ruff ..... E04B 1/6803 4/498
4,359,295 A * 11/1982 Honegger ..... E01D 19/06 404/68
4,572,702 A * 2/1986 Bone ..... E01D 19/06 14/73.5

(Continued)

FOREIGN PATENT DOCUMENTS

CA 3017425 A1 * 10/2017 ..... E01C 11/02
DE 1208755 B * 1/1966 ..... E01D 19/06

(Continued)

*Primary Examiner* — Thomas B Will
*Assistant Examiner* — Katherine J Chu
(74) *Attorney, Agent, or Firm* — Roberts Mlotkowski Safran Cole & Calderon P.C.

(57) ABSTRACT

A finger joint having a bridging cover plate, which enables a steel plate having a thickness much smaller than that of a conventional finger to be used and allows the vertical rotation of an upper bridge structure. The finger joint includes: a bridging cover plate installed on a first structure and supported to a second structure across a gap so as to support a load of a vehicle passing over the gap, and configured to allow relative movement between the first structure and the second structure in a direction in which the distance of the gap changes; a first finger unit connected to the bridging cover plate; and a second finger unit installed on the second structure so as to allow relative movement relative to the first finger unit in a direction in which the distance of the gap changes.

19 Claims, 12 Drawing Sheets

(56) References Cited

U.S. PATENT DOCUMENTS 5,048,249 A * 9/1991 Shreiner ..... E01C 11/126 404/64
5,213,441 A * 5/1993 Baerveldt ..... E01D 19/06 404/66
5,269,624 A * 12/1993 Kramer ..... E01D 19/06 404/64
5,584,152 A * 12/1996 Baerveldt ..... B29D 99/0053 52/396.05
5,628,857 A * 5/1997 Baerveldt ..... B29D 99/0053 156/244.25
6,115,980 A * 9/2000 Knak ..... E04B 1/681 52/396.04
6,460,214 B1 * 10/2002 Chang ..... E01D 19/06 14/73.1
6,609,265 B1 * 8/2003 Jee ..... E01D 19/06 14/73.1
7,389,555 B2 * 6/2008 Xu ..... E01D 19/06 14/73.1
7,484,259 B2 * 2/2009 Xu ..... E01D 19/06 14/73.1
8,696,205 B2 * 4/2014 Tavecchio ..... E01D 19/04 384/36
9,435,087 B2 * 9/2016 Kim ..... F16C 13/04
2007/0044257 A1 * 3/2007 Xu ..... E01D 19/06 14/73.1
2007/0199267 A1 * 8/2007 Moor ..... E01D 19/06 52/393
2008/0196183 A1 * 8/2008 Xu ..... E01D 19/06 14/73.1
2009/0064602 A1 * 3/2009 Lee ..... E01D 19/06 52/167.1
2014/0242863 A1 * 8/2014 Voet ..... E01C 11/10 442/59

FOREIGN PATENT DOCUMENTS

EP 3279399 A1 * 2/2018 ..... E01D 19/06
FR 2775991 A1 * 9/1999 ..... E01D 19/06
JP 2005-009312 A 1/2005
JP 2007-517996 A 7/2007
JP 2008-542590 A 11/2008
KR 20-0219970 Y1 4/2001
KR 20-0265456 Y1 2/2002
KR 10-0757212 B1 9/2007
WO WO-2017167830 A1 * 10/2017 ..... E01C 11/02

* cited by examiner

FINGER JOINT WITH A BRIDGING COVER PLATE

CROSS-REFERENCE TO RELATED APPLICATION

This application is based on and claims priority under 35 USC 119 to a Korean Patent Application No. 10-2017-0011770 filed on Jan. 25, 2017, the disclosure of which is incorporated by reference herein.

TECHNICAL FIELD

The present invention relates to an improvement of an expansion joint device installed between two structures, for example, between upper structures of an elevated road or a bridge, which have a gap therebetween, the distance of which changes, and particularly relates to improvement of a finger joint.

BACKGROUND ART

Generally, an upper structure of a bridge is expanded or contracted due to temperature change, drying shrinkage, creep, etc., and is moved due to a dynamic load applied due to vehicle passage, an earthquake, etc. Therefore, an appropriate gap is provided between two neighboring upper structures according to the material, length, support structure, etc. of a bridge floor slab during the construction of the bridge. An expansion joint device is installed between upper structures, and a finger-type expansion joint device is frequently used.

Among expansion joint devices, when a modular joint is used in a place where the amount of expansion and contraction of upper structures is very large, the number of parts increases and the structure of the modular joint becomes complicated, making it difficult to achieve structural stability and economic efficiency.

When a finger joint system is used in a place where the amount of expansion and contraction of upper structures is very large, it is necessary to set a very large interval between two abutment points. Thus, the thickness of necessary fingers becomes too thick and exceeds the thickness of an ordinarily available iron plate. As a result, it is difficult to obtain the fingers on the market. In addition, when the thickness of the iron plate is too large, it is difficult to handle the iron plate because the steel plate is heavy, and it is very difficult to cut the steel plate into a finger shape and to smooth the surface of the finger.

DETAILED DESCRIPTION OF THE INVENTION

Technical Problem

An object of the present invention is to provide a finger joint, which is capable of significantly reducing the thickness of an iron plate necessary for manufacturing the finger joint compared with conventional ones.

Another object of the present invention is to provide a finger joint, which is capable of significantly reducing the thickness of an iron plate necessary for manufacturing a finger joint, so that the finger joint is suitable for use in a medium-length bridge, a long bridge, or a super-long bridge, in which the amount of expansion and contraction is large.

Still another object of the present invention is to provide a finger joint, which is excellent in structural stability and provides good vehicle traveling properties compared with conventional finger joints.

Still another object of the present invention is to provide a finger joint, which is capable of preventing occurrence of a line contact portion between the finger joint and a structure when a height difference is generated between two structures provided with the finger joint.

Still another object of the present invention is to provide a finger joint, which is capable of allowing transverse displacement between two structures, which are provided with a finger joint.

Still another object of the present invention is to provide a finger joint, which is capable of allowing movement in various directions between two structures, which are installed in a curved bridge or a skew bridge and disposed to be spaced apart from each other.

Yet another object of the present invention is to provide a finger joint, in which finger joint components are prevented from being damaged by allowing two structures, which are disposed to be apart from each other, to move in all directions of front, back, up, down, left, and right during an earthquake, and in which no problem occurs in vehicle passage even after the earthquake.

Technical Solution

According to the present invention, there is provided a finger joint installed between a first structure and a second structure, which are disposed with a gap therebetween, a distance of which changes as the first structure and the second structure are expanded or contracted due to temperature change or the like or as the first structure and the second structure are moved by an earthquake or the like, so as to enable a vehicle to smoothly pass over the gap. The finger joint includes: a bridging cover plate installed on the first structure and supported to the second structure across the gap so as to support a load of a vehicle passing over the gap, and configured to allow relative movement between the first structure and the second structure in a direction in which the distance of the gap changes; a first finger unit including a plurality of first fingers connected to the bridging cover plate and supported by the second structure, and a plurality of first finger grooves each formed between neighboring the first fingers; and a second finger unit including a plurality of second fingers configured to be inserted into the first finger grooves, respectively, and a plurality of second finger grooves each formed between neighboring the second fingers, the second finger unit being installed on the second structure so as to allow relative movement relative to the first finger unit in a direction in which the distance of the gap changes.

The finger joint may further include: a first support unit installed on the first structure and configured to support a bottom surface of the bridging cover plate on the first structure to be floated from a floor of the first structure; a second support unit installed on the second structure and configured to support the bottom surface of the bridging cover plate on the second structure to be floated from a floor of the second structure, the second support unit being in sliding contact with the second structure; and an elastic pressing mechanism installed on the first structure between the first support unit and the second support unit or on a protrusion structure protruding from the first structure toward the second structure, and configured to elastically press the bridging cover plate downward.

The first support unit may include: a groove member installed on a top surface of the first structure or the bottom surface of the bridging cover plate, and having a spherical groove or a cylindrical groove; and a convex member installed on any one of the top surface of the first structure and the bottom surface of the bridging cover plate where the groove member is not installed, and having a convex spherical surface or a convex cylindrical surface coupled to the spherical groove or the cylindrical groove so as to allow the bridging cover plate to pivot up and down.

The spherical groove or the cylindrical groove may be formed on the bottom surface of the bridging cover plate over the second structure, and the second support unit may include a block having a convex spherical surface or a convex cylindrical surface formed on a top surface thereof so as to be coupled to the spherical groove or the cylindrical groove, and a bottom surface formed as a flat surface.

The spherical groove or the cylindrical groove may be formed on the bottom surface of the bridging cover plate over the second structure, and the second support unit may include an engineering plastic block having a convex spherical surface or a convex cylindrical surface formed on a top surface thereof so as to be coupled to the spherical groove or the cylindrical groove, which is formed on the bottom surface of the bridging cover plate, and a bottom surface formed as a flat surface.

The finger joint may further include a support block installed on a bottom surface of the first finger over the second structure, and configured to support the first finger on the second structure and to be in sliding contact with the second structure.

The first finger unit may be coupled to the bridging cover plate through a connecting mechanism, and the connecting mechanism may include: a connecting member coupled to the first finger unit and having a hole formed in a portion disposed below the bridging cover plate; a sliding material installed on a bottom surface of the connecting member and configured to be in sliding contact with the second structure; an elastic support installed between the connecting member and the bridging cover plate; and a connecting body coupled to the bridging cover plate and having an end portion penetrating the elastic support and inserted into the hole.

In some cases, the first finger unit may be coupled to the bridging cover plate through a connecting mechanism, and the connecting mechanism may include: a connecting member having a hole formed in a portion disposed below the bridging cover plate and coupled to the first finger; a convex member provided at one of a bottom surface of the bridging cover plate and a position of being inserted into the hole to be in sliding contact with the second structure and having a convex spherical surface or a convex cylindrical surface; and a concave member provided at a remaining one of the bottom surface of the bridging cover plate and the position of being inserted into the hole to be in sliding contact with the second structure and having a concave spherical surface or a concave cylindrical surface coupled to the convex spherical surface or the convex cylindrical surface.

The first finger unit may be disposed to be spaced apart from the bridging cover plate, and a filling material may be filled between the bridging cover plate and the first finger unit, so that the first finger unit and the bridging cover plate allow a pivoting operation therebetween.

In some cases, the first finger unit may be integrally formed at an end portion of the bridging cover plate.

The second finger may be fixed to the second structure via a fixing mechanism in the state of being supported through a metal block.

The finger joint may further include a base plate installed on each of the first structure and the second structure, and a stainless-steel plate may be installed on the base plate of the second structure.

In some cases, the finger joint may further include a slide support block installed on the second structure and configured to support the first finger and to be in sliding contact with the bottom surface of the first finger.

In some cases, the first finger unit may be installed on the bridging cover unit through a connecting mechanism to be relatively movable in a transverse direction perpendicular to a longitudinal direction of a bridge, which is a direction in which the distance of the gap is changed.

The hole may be formed to be longer than one of the convex member and the concave member, which is inserted into the hole, in a transverse direction perpendicular to a longitudinal direction of a bridge in which the distance of the gap is changed, so as to allow transverse movement of the first finger unit with respect to the bridging cover plate.

The first finger unit may be coupled to the bridging cover plate through the connecting mechanism, and the connecting mechanism may include: a connecting member having a hole or a groove formed in a portion disposed under the bridging cover plate and coupled to the first finger unit; and an escape prevention unit installed on the bridging cover plate and inserted into the hole or the groove so as to prevent the first finger unit from escaping from the bridging cover plate, the escape prevention unit being installed to be relatively movable in a transverse direction perpendicular to a longitudinal direction of a bridge which is a direction in which a distance of the gap changes.

The second support unit may include: a convex member provided at one of a bottom surface of the bridging cover plate over the second structure and a position where the convex member is in sliding contact with the second structure and having a convex spherical surface or a convex cylindrical surface; and a concave member provided at a remaining one of the bottom surface of the bridging cover plate on the second structure and a position where the concave member is in sliding contact with the second structure and having a spherical groove or a concave cylindrical surface coupled to the convex spherical surface or the convex cylindrical surface.

Advantageous Effects

According to the present invention, between two structures, which are disposed with a gap, a bridging cover plate is disposed immediately above the gap and both sides of the bridging cover plate are supported by the two structures. Thus, the sectional area, which is compressed by the wheels of a passing vehicle and supports an axial load becomes much larger than the cross-sectional area supported by the existing fingers. Accordingly, a steel plate having a thickness, which is much smaller than that of the conventional fingers can be used, so that it is possible to eliminate the difficulties of cutting a very thick steel plate into a finger shape and of smoothly machining the surface thereof.

According to the present invention, it is possible to provide a safe joint structure since a joint system installed just above a gap between two structures can take a simple beam support type using a simple iron plate.

According to the present invention, the bridging cover plate provided on the gap allows to solve complicated and machining-related matters as in a modular or finger joint which is generally used at present.

According to the present invention, it is possible to provide a finger joint, which can be appropriately used for a middle-length bride or a long bridge, and which is particularly excellent in usability for a super-long bridge, in which the large amount of expansion and contraction is very large.

In the bridge equipped with the finger expansion joint according to the present invention, the vehicle running properties are excellent, and it is possible to install blocks, which support first and second fingers and have relatively weaker strength than that of the bridging cover plate, on the second structure at very narrow installation intervals. Thus, the damage of the first and second fingers can be minimized, and the thickness of the first and second fingers can be significantly reduced compared with the conventional ones.

In some cases, it is possible to configure the entire bottom surfaces of the first and second fingers so as to be in contact with the second structure.

The finger joint according to the present invention easily allows the vertical rotation of an upper bridge structure, and is not complicated in structure, so that the finger joint can be conveniently maintained and repaired.

MODE FOR CARRYING OUT THE INVENTION

Hereinafter, embodiments of the present invention will be described in detail with reference to the accompanying drawings.

Figure 1:
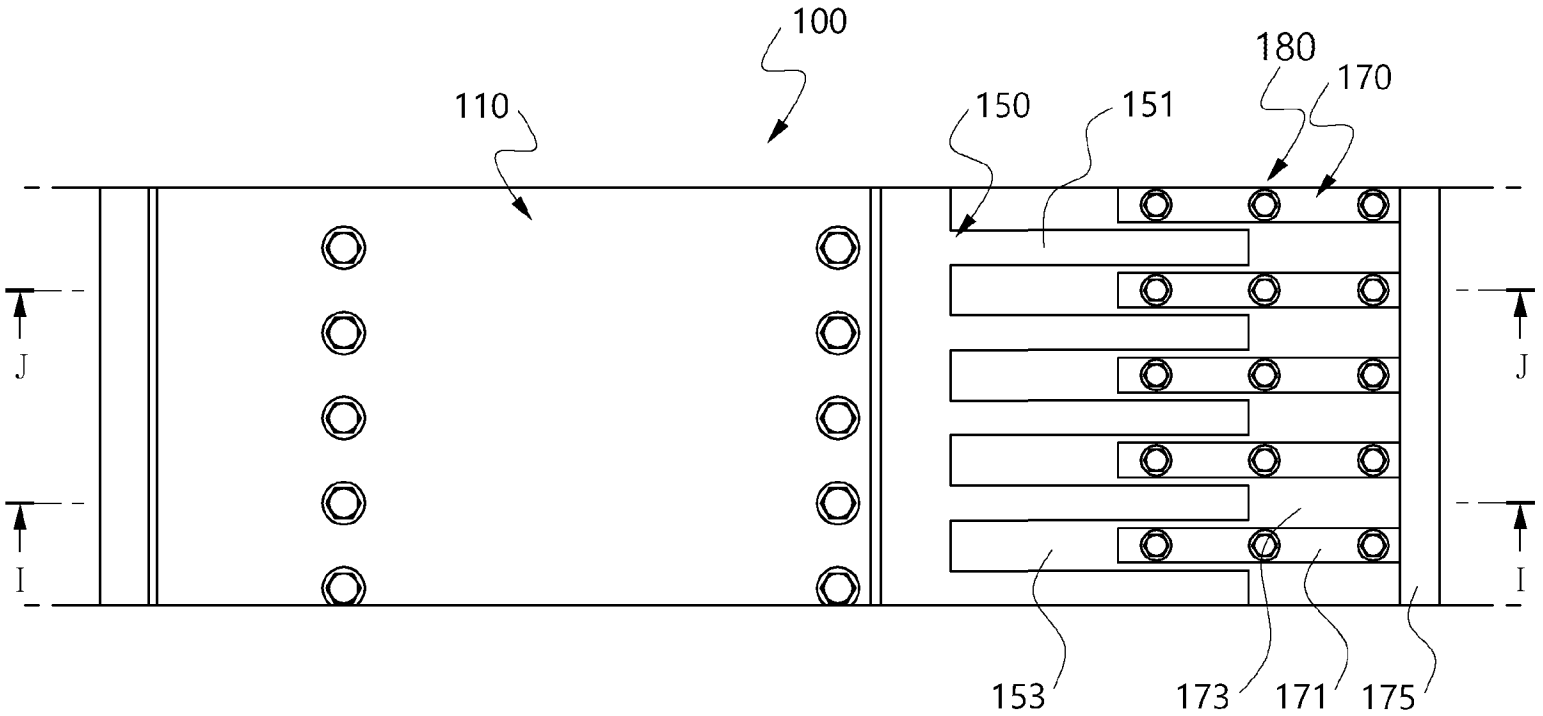
FIG. 1 is a partial plan view of a finger joint with a bridging cover plate according to the present invention.
Figure 2:
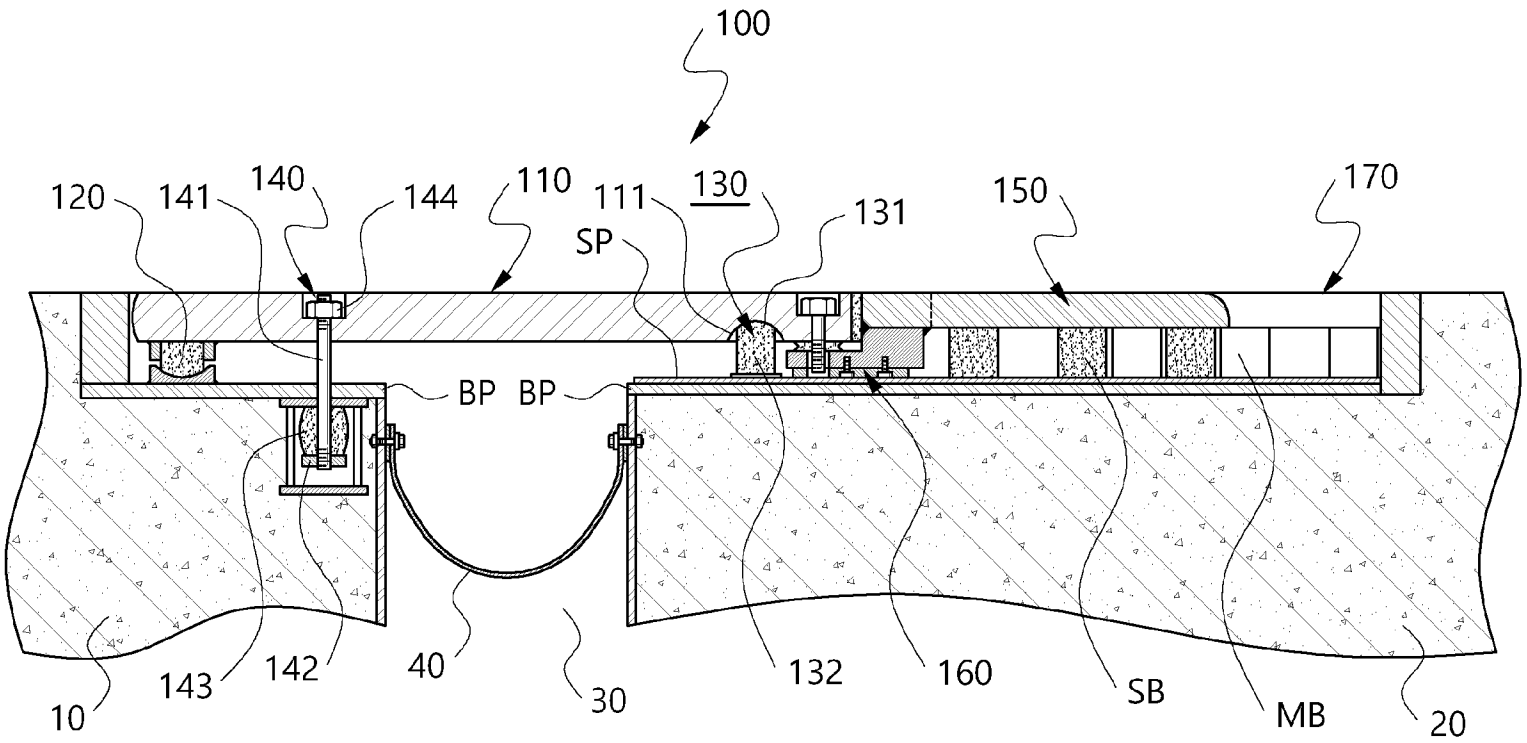
FIG. 2 is a sectional view taken along line I-I in FIG. 1.
Figure 3:
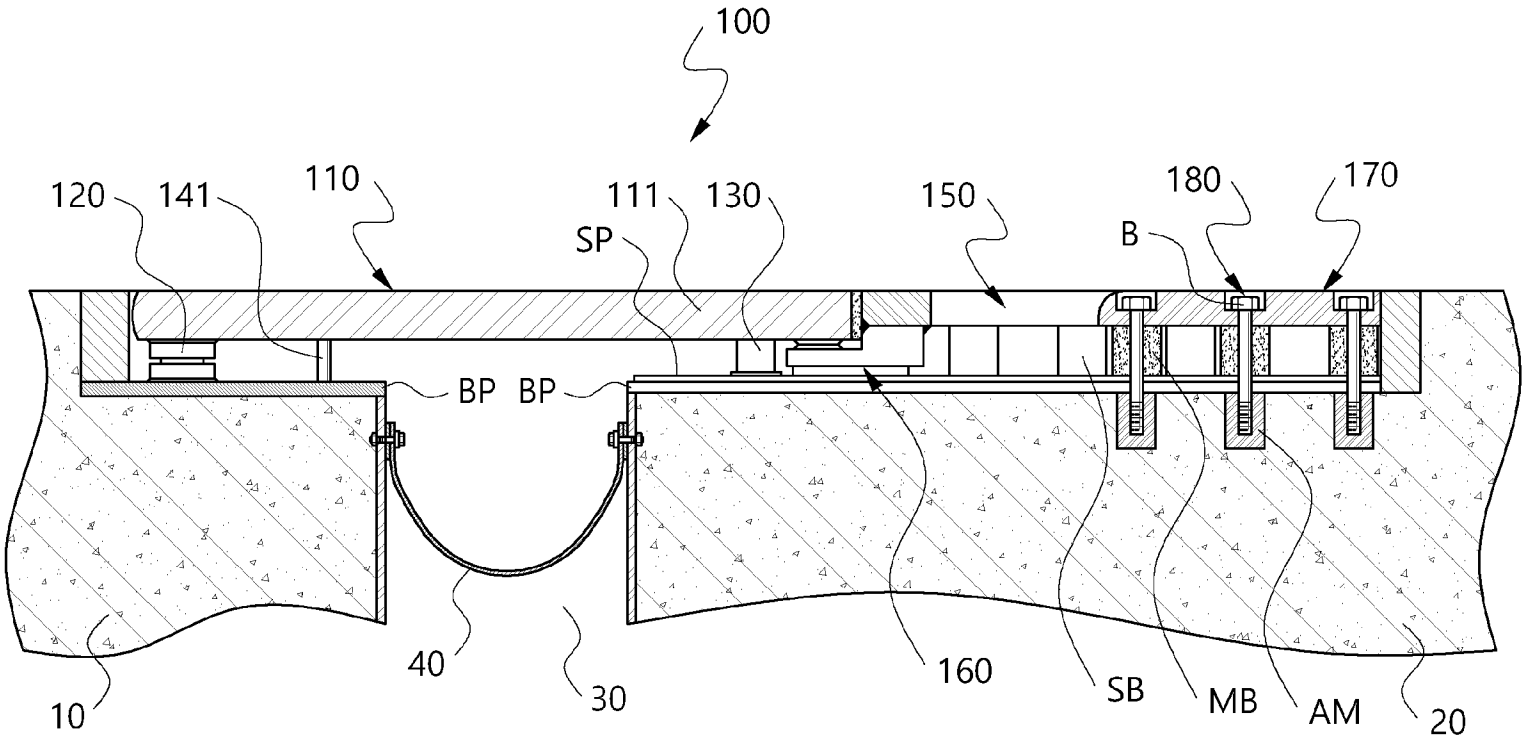
FIG. 3 is a sectional view taken along line J-J in FIG. 1, in which an installation state of a second finger unit is illustrated.
Figure 4:
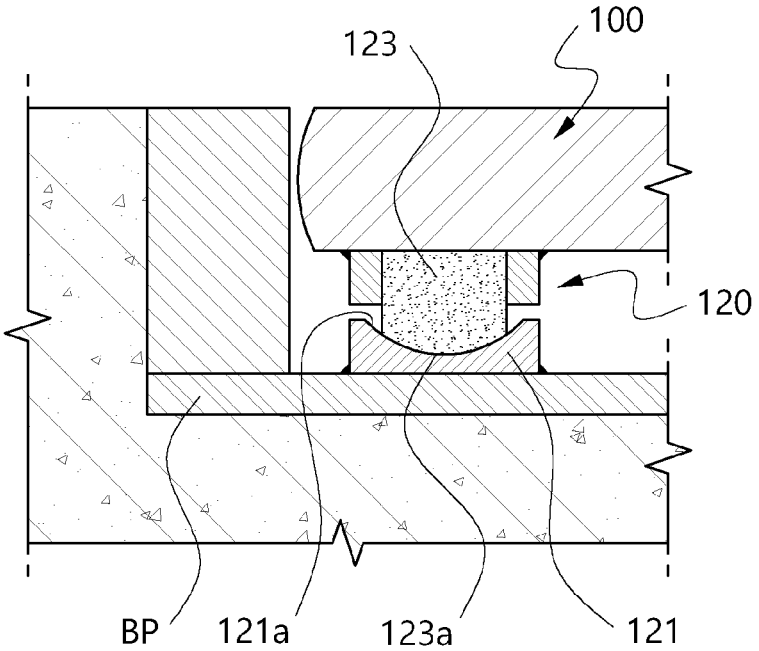
FIG. 4 is an enlarged sectional view of a first support unit.
Figure 5:
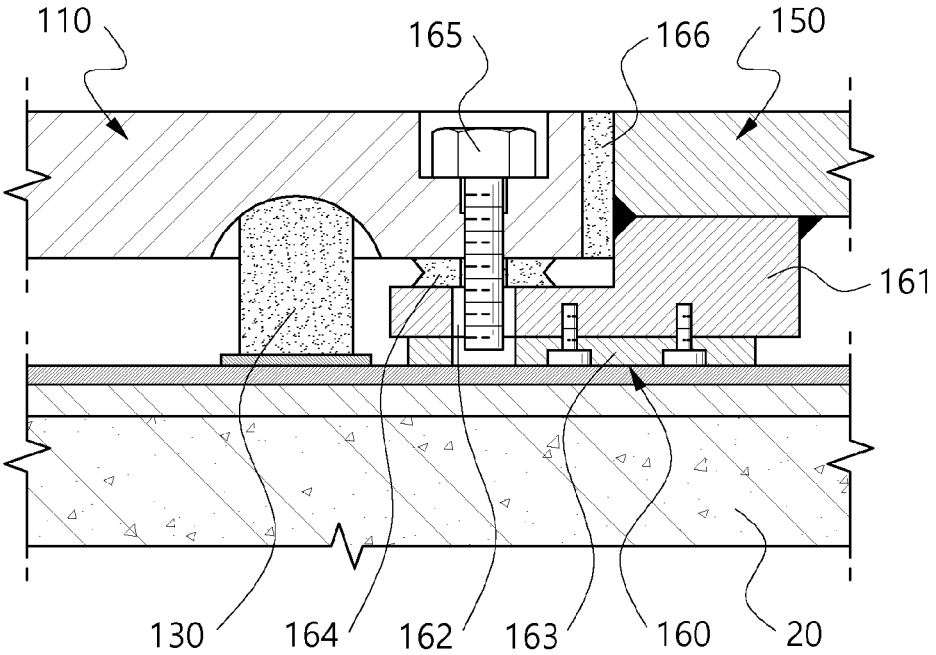
FIG. 5 is an enlarged sectional view of a second support unit and a connecting mechanism.

FIG. 1 is a partial plan view of a finger joint with a bridging cover plate according to the present invention, FIG. 2 is a sectional view taken along line I-I in FIG. 1, FIG. 3 is a sectional view taken along line J-J in FIG. 1, in which an installation state of a second finger unit is illustrated, FIG. 4 is an enlarged sectional view of a first support unit, and FIG. 5 is an enlarged sectional view of a second support unit and a connecting mechanism.

As illustrated in FIGS. 1 to 5, a finger joint 100 having a bridging cover plate according to the present invention is installed between two structures, i.e. a first structure 10 and a second structure 20, which are disposed with a gap 30 therebetween, so that vehicles can smoothly pass over the gap 30.

The first and second structures 10 and 20 are expanded or contracted due to temperature change, drying shrinkage, creep, or the like, and thus the distance of the gap 30 is increased or decreased. In addition, even in the case in which the first and second structures 10 and 20 are moved by an earthquake or a dynamic load, which is applied due to starting or braking of a vehicle or a train traveling on the first and second structures 10 and 20, each of which is made of a bridge floor slab or the like, the distance of the gap 30 changes. In order to receive the change of the distance of the gap 30, an expansion joint is required.

In addition, a water trap 40 is provided between the first and second structures 10 and 20 in order to prevent rainwater or the like from falling down through the gap 30.

As illustrated in FIGS. 2 and 3, a base plate BP is provided on the floor of each of the first structure 10 and the second structure 20. In addition, a stainless-steel plate SP is provided on the base plate BP of the second structure 20. This stainless-steel plate SP is for sliding contact and may be replaced by other sliding plates.

The finger joint 100 according to the present invention includes a bridging cover plate 110. The bridging cover plate 110 is a feature of the present invention and is installed on the second structure 20 across the gap 30 after being installed on the first structure 10. The bridging cover plate 110 supports the load of vehicles passing over the gap 30 and allows relative movement between the first structure 10 and the second structure 20 in the direction in which the distance of the gap 30 changes in the state of being installed on the first structure 10 and the second structure 20. Since the whole cross section of the bridging cover plate 110 in the direction perpendicular to bridge or in the longitudinal direction of the gap 30 in the bridge receives a moment by the dynamic load of the vehicles passing over the gap 30, the thickness of bridging cover plate 110 can be greatly reduced in comparison with the fingers disposed at an interval.

Preferably, the bridging cover plate 110 is supported by a first support unit 120 installed on the first structure 10 and a second support unit 130 installed on the second structure 20. In the state of being installed on the first structure 10, the first support unit 120 supports the bottom surface of the bridging cover plate 110, thereby serving to support the bottom surface of the bridging cover plate 110 to be floated by a predetermined height from the floor of the first structure 10. In the state of being installed on the second structure 20, the second support unit 130 supports the bottom surface of the bridging cover plate 110 to be floated by a predetermined height from the floor of the second structure 20, and comes into slide contact with the second structure 20.

The first support unit 120 includes: a groove member 121, which is provided on the top surface of the first structure 10 and includes a spherical groove 121*a*; and a convex member 123, which is provided on the bottom surface of the bridging cover plate 110 and has a convex spherical surface 123*a*, which is coupled to the spherical groove 121*a* so as to allow the bridging cover plate 110 to pivot up and down.

Here, instead of the spherical groove 121*a*, a cylindrical groove may be formed. In this case, a convex cylindrical surface may be formed instead of the convex spherical surface 123*a*. Further, the groove member 121 and the convex member 123 may be reversely provided by reversing their positions up and down.

In addition, a spherical groove 111 or a cylindrical groove may be formed in the bottom surface of the bridging cover plate 110 on the second structure 20, and the second supporting unit 130 may be configured with an engineering plastic block 132 having a convex spherical surface 131 or a convex cylindrical surface formed therein to be coupled to the spherical groove 111 or the cylindrical groove, which is formed in the bottom surface of the bridging cover plate 110. Of course, the bottom surface of the engineering plastic block 132 is formed in a flat surface and is in sliding contact with the stainless-steel plate SP provided on the second structure 20.

An elastic pressing mechanism 140 is installed on the first structure 10 between the first support unit 120 and the second support unit 130 so as to elastically press the bridging cover plate 110 downward. The elastic pressing mechanism 140 may be configured to have an elastic body 143, which is made of polyurethane or the like, mounted on the outer peripheral surface of a shaft member 141 under the base plate BP, hooked on an engagement step 142, and compressed through a nut 144, which is coupled to the shaft member 141 protruding toward the upper surface of the bridging cover plate 110.

Even if a downward deflection is generated at the center portion of the bridging cover plate 110 when a vehicle passes over the bridging cover plate 110 installed as described above, the rotation of both ends of the bridging cover plate 110 by the deflection can be smoothly received by the first support unit 120 and the second support unit 130.

The finger joint 100 according to the present invention includes a first finger unit 150. The first finger unit 150 is connected to the bridging cover plate 110 installed on the second structure 20, preferably via a connecting mechanism 160, and is supported by the second structure 20. The first finger unit 150 has a plurality of first fingers 151 and a plurality of first finger grooves 153 each formed between neighboring first fingers 151.

The first finger 151 may be supported by the second structure 20 via the support blocks SB provided on the bottom surface thereof. Since the interval between the support blocks SB is much smaller than the distance between two points for supporting the bridging cover plate 110 and the first finger 151 mainly receives a compressive force capable of withstanding a load larger than a bending moment, so that the first finger 151 can be formed to have a thickness, which is much smaller than the thickness of the bridging cover plate 110.

Since the support blocks SB provided on the bottom surface of the first finger 151 have to be in sliding contact with the second structure 20, the bottom surface of the support blocks SB is preferably formed as a flat surface.

Although not illustrated in the drawing, in some cases, instead of the support blocks SB provided on the bottom surface of the first finger 151, a slide support block, which supports the first finger 151 and is in sliding contact with the bottom surface of the first finger 151, may be fixedly mounted on the second structure 20. This can be easily understood by considering that the support blocks SB are fixed on the upper surface of the second structure 20 and are in sliding contact with the bottom surface of the first finger 151.

Of course, in some cases, the first finger unit 150 may be formed to have a large thickness and a sliding material may be provided on the bottom surface thereof.

Referring to FIG. 5, the connecting mechanism 160 is provided with a connecting member 161. The connecting member 161 has a hole 162 formed in the portion disposed under the bridging cover plate 110, and the portion of the connecting member 161, which is disposed under the first finger unit 150, is coupled to the first finger unit 150. A sliding material 163, which is in sliding contact with the second structure 20, is provided on the bottom surface of the connecting member 161. As the sliding material 163, an engineering plastic such as polyamide may be used. In addition, an elastic support body 164 is provided between the connecting member 161 and the bridging cover plate 110, and a bolt 165, which passes through the elastic support body 164 such that the end portion of the bolt 165 is inserted into the hole 162, is screw-coupled to the bridging cover plate 110, thereby serving as the connecting body. Of course, any other connecting body such as a pin may be used instead of the bolt 165. As the elastic support 164, a Polytron disc made of polyurethane is suitable.

A sealing material 166 having elasticity, such as silicon, may be filled between the bridging cover plate 110 and the first finger unit 150 so as to seal the gap between the bridging cover plate 110 and the first finger unit 150, thereby preventing water or other foreign matter from flowing into the gap.

Accordingly, the bridging cover plate 110 and the first finger unit 150 are allowed to rotate slightly upward and downward with respect to each other.

The finger joint 100 according to the present invention is provided with a second finger unit 170. The second finger unit 170 is installed on the second structure 20 and includes a plurality of second fingers 171, which can be respectively inserted into the first finger grooves 153, and a plurality of second finger groove 173, each of which is formed between neighboring second fingers 171 such that the first fingers 151 can be respectively inserted into the second finger grooves 173. The second finger unit 170 is installed on the second structure 20 so as to allow the relative movement with respect to the first finger unit 150 in a direction in which the distance of the gap 30 changes. The second fingers 171 may be integrally connected through the connecting portion 175.

As illustrated in detail in FIG. 3, the second finger unit 170 described above is rigidly fixed to the second structure 20 through a fixing mechanism 180, each of which includes a bolt B, an anchor mechanism AM, etc. in a state of being supported via a metal block MB. The bolt B may be fixed to the second structure 20 through the metal block MB. In some cases, an engineering plastic block may be used instead of the metal block MB.

Figure 6:
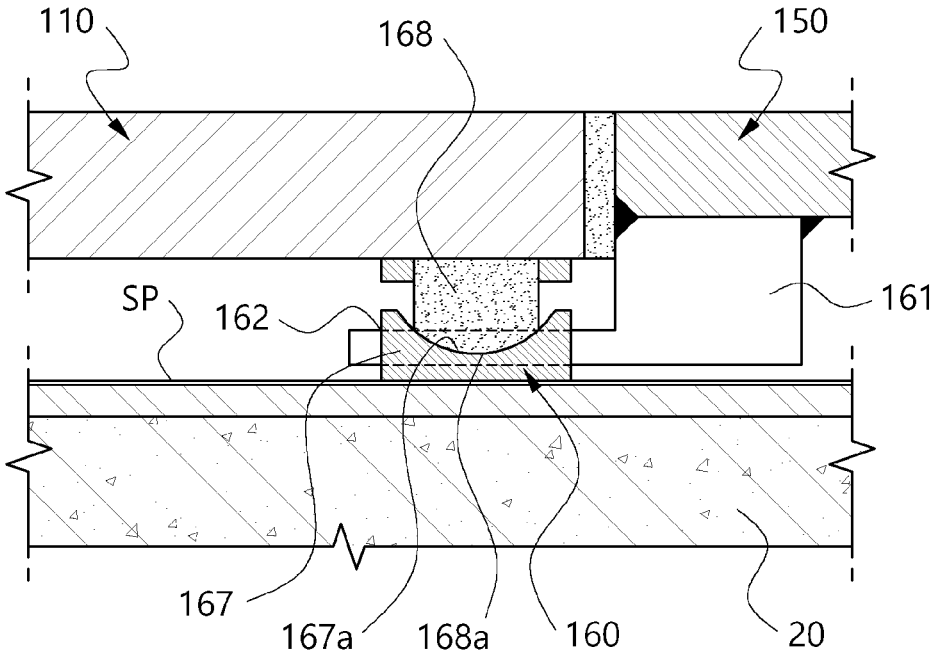
FIG. 6 is a sectional view illustrating another example of a connecting mechanism.

FIG. 6 is a sectional view illustrating another example of the connecting mechanism.

In some cases, the connecting mechanism 160 includes a connecting member 161, a concave member 167, and a convex member 168.

The connecting member 161 includes a hole 162 formed in the portion thereof, which is disposed under the bridging cover plate 110, and the portion thereof, which is disposed under the first finger unit 150, is coupled to the first finger unit 150.

The concave member 167 is inserted into the hole 162 and moves in the horizontal direction together with the connecting member 161. A concave spherical surface 167*a* or a semicircular concave cylindrical surface is formed on the top surface of the concave member 167. In addition, the bottom surface of the concave member 167 is in sliding contact with the stainless-steel plate SP on the second structure 20.

The convex member 168 is fixed to the bottom surface of the bridging cover plate 110 and has a convex spherical surface 168*a* or a convex cylindrical surface that is coupled to the concave spherical surface 167*a* or the concave cylindrical surface.

The concave member 167 and the convex member 168 can be reversely provided by changing their installation positions up and down. The connecting member 161 may be elongated in the direction perpendicular to the bridge, so that a plurality of the concave members 167 or the convex members 168 can be installed.

Figure 7:
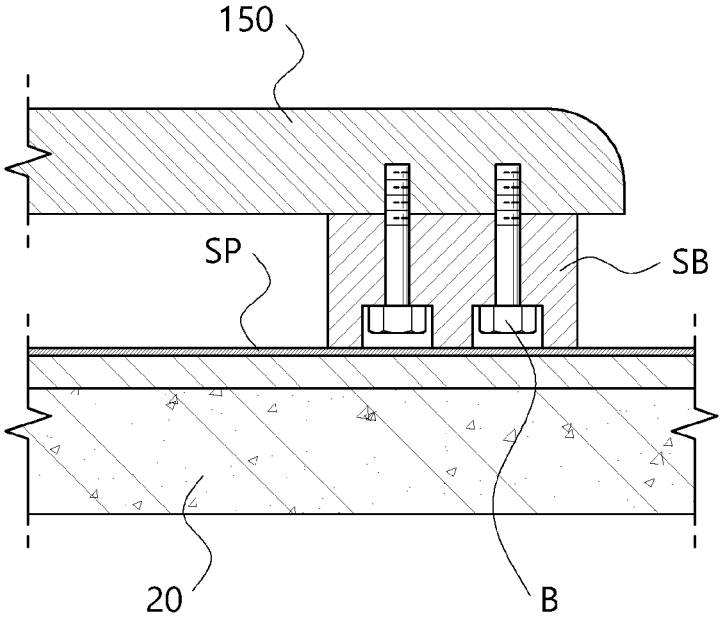
FIG. 7 is a sectional view illustrating an installation example of a support block provided on the bottom surface of the first finger unit.

FIG. 7 is a sectional view illustrating an installation example of a support block provided on the bottom surface of the first finger unit.

As illustrated in FIG. 7, the support block SB provided on the bottom surface of the first finger unit 150 may be fixed to the bottom surface of the first finger unit 150 through the bolts B. As the support block SB, a sliding material having a small frictional coefficient is desirable. An engineering plastic, which is formed of polyamide or the like and has a small frictional coefficient is suitable. Of course, other sliding materials such as PTFE may be used. A stainless-steel plate SP is installed on the floor of the second structure 20.

The remaining features are the same as those described with reference to FIGS. 1 to 5.

Figure 8:
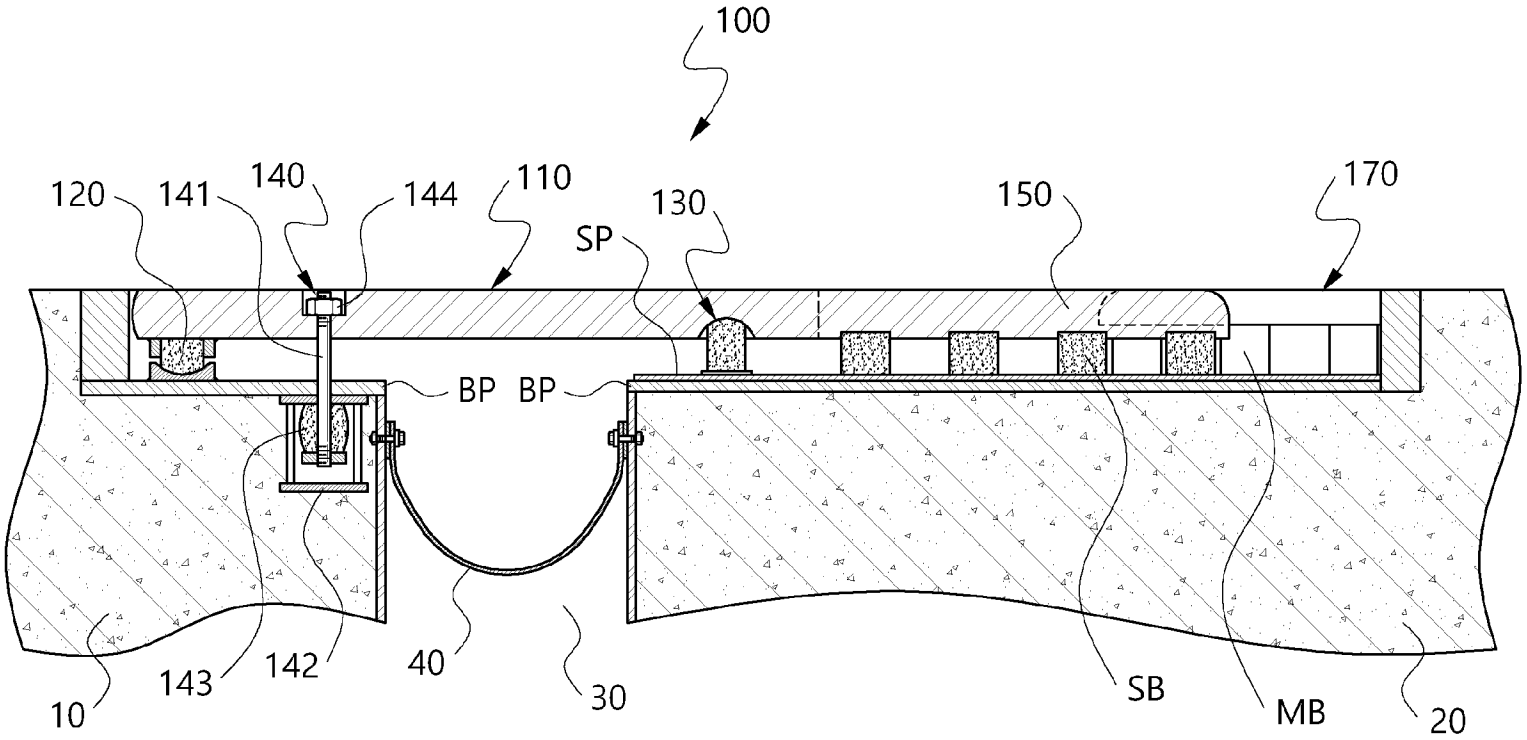
FIG. 8 is a sectional view illustrating a modification of the finger joint having the bridging cover plate according to the present invention.

FIG. 8 is a sectional view illustrating a modification of the finger joint having the bridging cover plate according to the present invention. Descriptions will be made with reference to both of FIGS. 1 and 2.

In some cases, the bridging cover plate 110 and the first finger unit 150, which are illustrated in FIGS. 1 and 2, may be integrally formed. That is, the first finger grooves 153 may be formed at one end portion of the iron plate having the width corresponding to the sum of the widths of the bridging cover plate 110 and the first finger unit 150 so that the bridging cover plate 110 and the first finger unit 150 can be integrally formed. In this case, the connecting mechanism described in the previous embodiment is not required.

The remaining features are the same as those described with reference to FIGS. 1 to 7.

Figure 9:
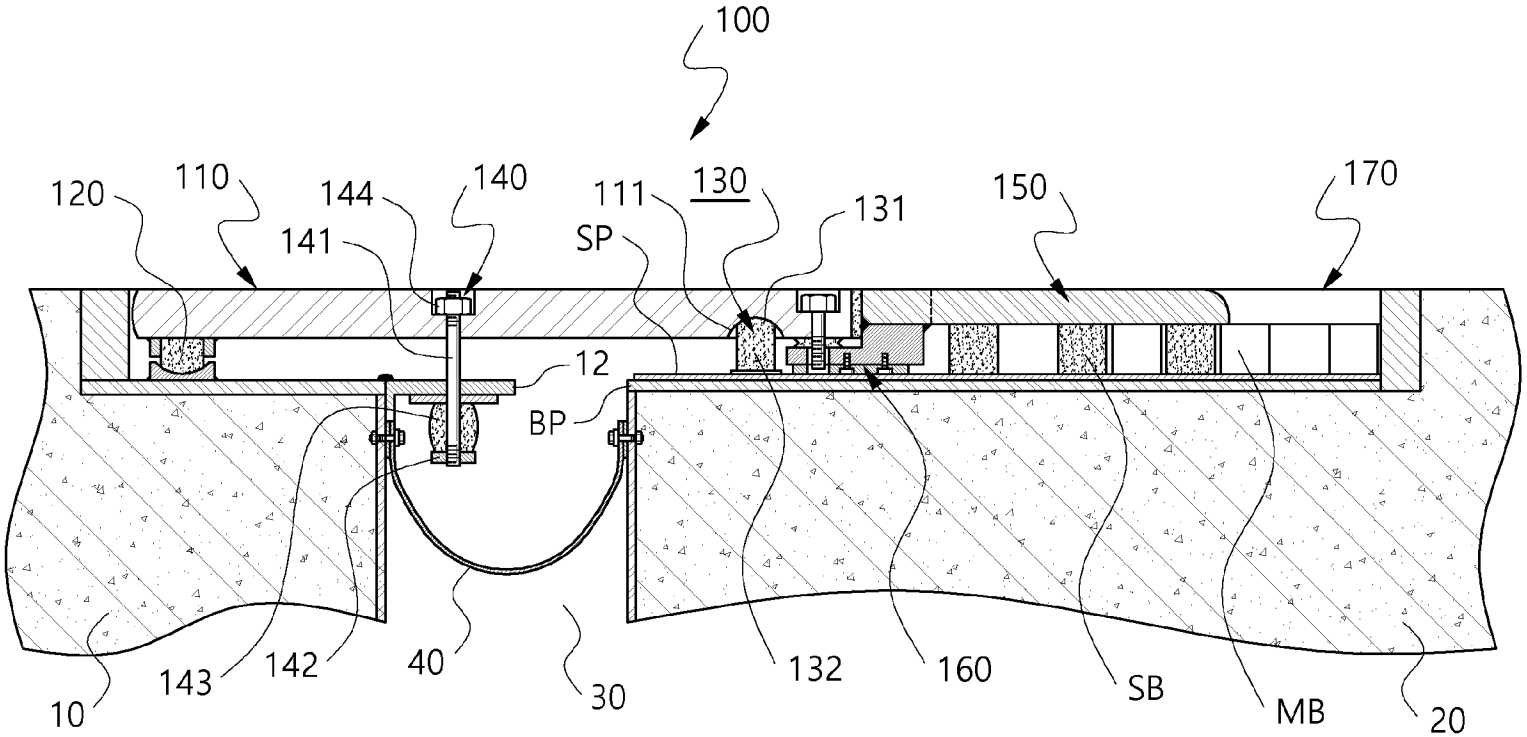
FIG. 9 is a sectional view illustrating another modification of the finger joint having the bridging cover plate according to the present invention.

FIG. 9 is a sectional view illustrating another modification of the finger joint having the bridging cover plate according to the present invention. Descriptions will be made with reference to both of FIGS. 1 and 2.

In some cases, a protrusion structure 12 protruding toward the second structure 20 may be provided on the first structure 10, and the elastic pressing mechanism 140 may be installed on the protrusion structure 12 so as to elastically press the bridging cover plate 110 downward. The elastic pressing mechanism 140 may be configured to have an elastic body 143, which is made of polyurethane or the like, mounted on the outer peripheral surface of a shaft member 141 protruding downward from the protrusion structure 12, hooked on an engagement step 142, and compressed through a nut 144, which is coupled to the shaft member 141 protruding toward the upper surface of the bridging cover plate 110. As the elastic body 143, any other elastic body such as a coil spring may be used instead of polyurethane.

In some cases, the engagement step 142 may be screw-coupled to the shaft member 141 such that the degree of compression of the elastic body 143 can be adjusted by rotating the engagement step 142.

The other components are the same as those described above with reference to FIGS. 1 to 3.

Figure 10:
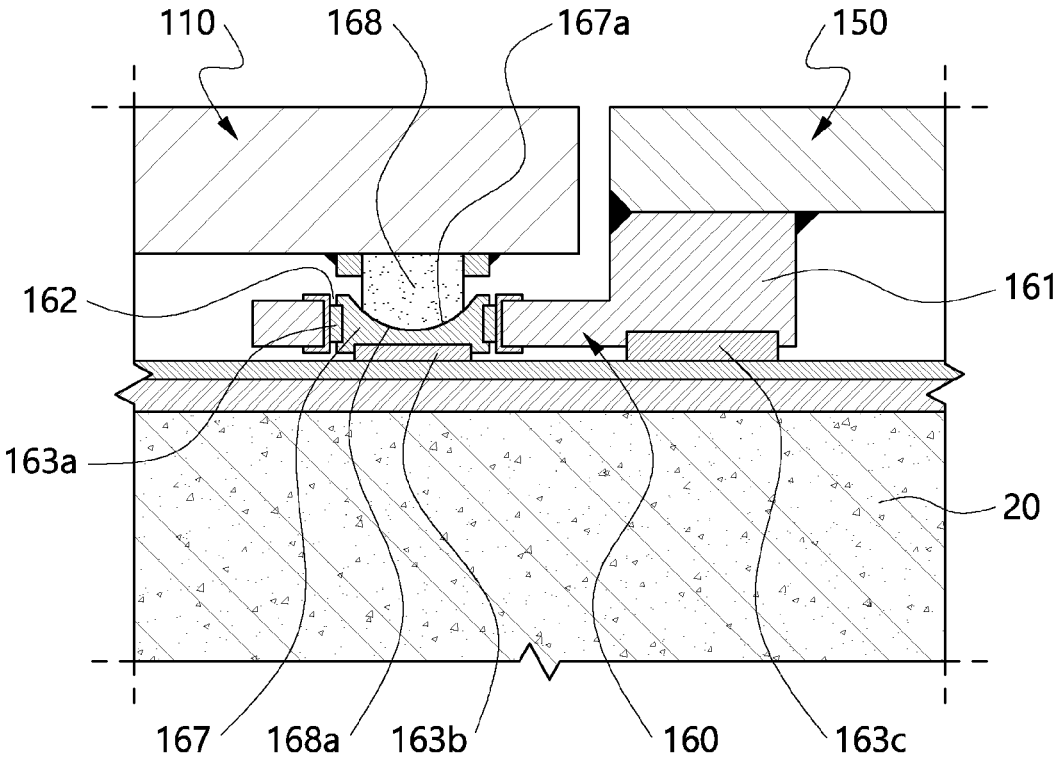
FIG. 10 is a sectional view illustrating a modification of that illustrated in FIG. 6.
Figure 11:
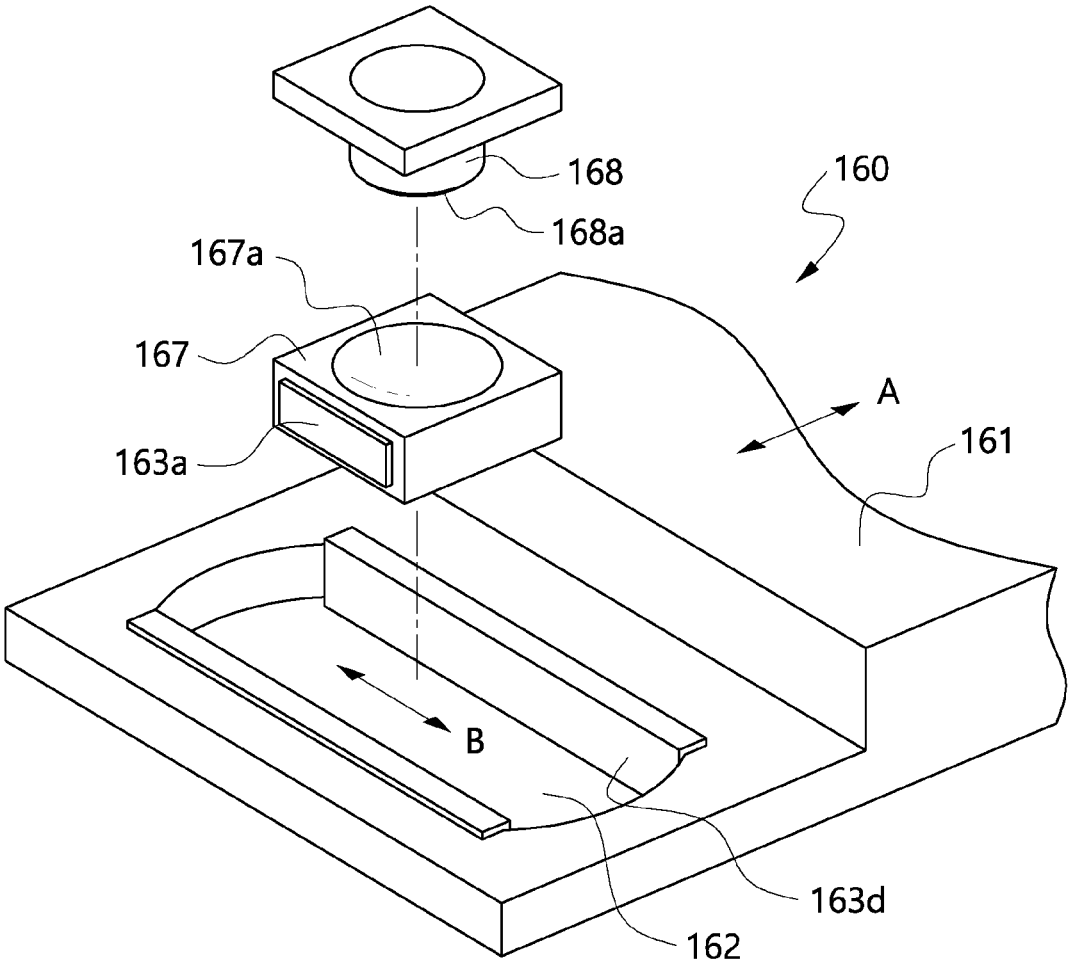
FIG. 11 is an exploded perspective view of a connecting mechanism illustrated in FIG. 10.

FIG. 10 is a sectional view illustrating a modification of that illustrated in FIG. 6, and FIG. 11 is an exploded perspective view of the connecting mechanism illustrated in FIG. 10.

In this embodiment as well, the connecting member 161 is attached to the bottom surface of the first finger unit 150, and a portion of the connecting member 161 is disposed below the bridging cover plate 110. The hole 162 formed in the portion of the connecting member 161, which is disposed below the bridging cover plate 110, is formed in the transverse direction (the direction indicated by arrow B in FIG. 11) perpendicular to the longitudinal direction of the bridge (the direction indicated by the arrow A in FIG. 11) in the form of a long hole to be longer the concave member 167 so as to guide the transverse movement of the concave member 167. Sliding materials 163*a*, 163*b*, and 163*c* made of an engineering plastic such as nylon or PTFE are attached to both the right and left side surfaces and the bottom surface of the concave member 167 and the bottom surface of the connecting member 161, and a sliding material 163*d* made of a stainless-steel plate or the like is attached to both the left and right inner surfaces of the hole 162 that guides the transverse movement of the concave member 167.

The convex member 168 attached to the bottom surface of the bridging cover plate 110 has a convex spherical surface 168*a*, which is convex downward, on the bottom surface thereof, and is inserted into the concave spherical surface 167*a* formed on the top surface of the concave member 167. The convex member 168 and the concave member 167 may be installed by changing the up and down positions thereof. The convex member 168 is preferably made of an engineering plastic such as nylon. The concave member 167 preferably may have a square or rectangular shape in a plan view, but may be modified into any other shape, which may be guided by the hole 162 in the transverse direction.

Figure 12:
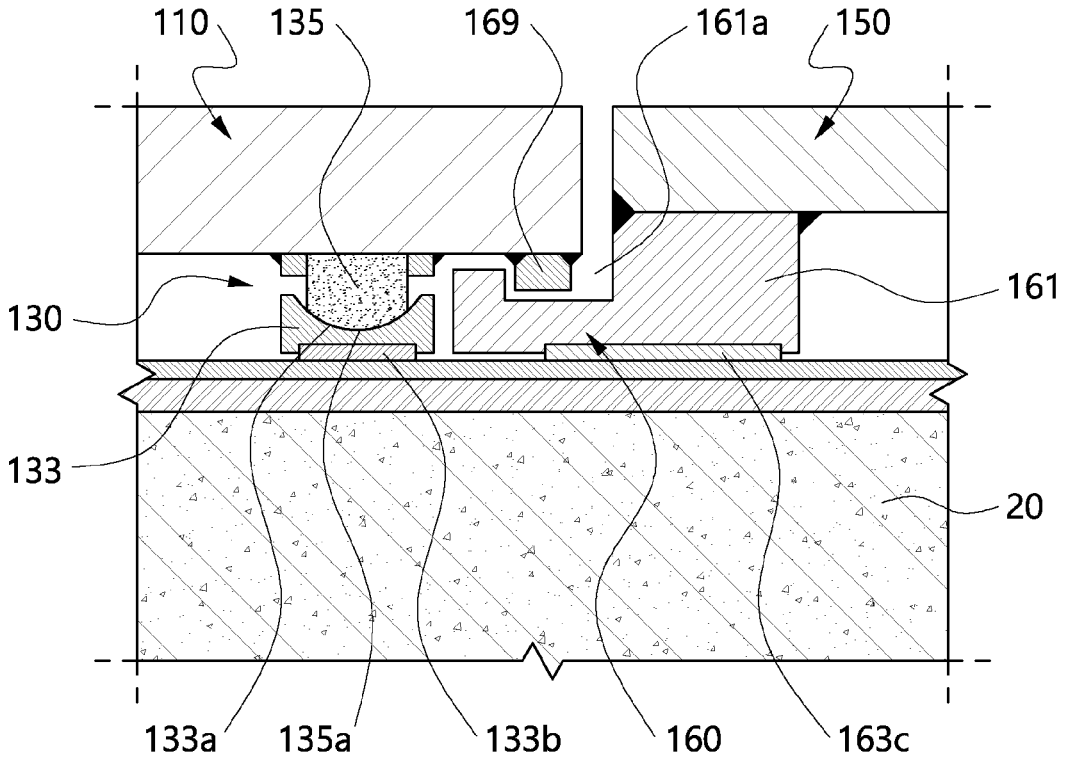
FIG. 12 is a sectional view illustrating another modification of the connecting mechanism.
Figure 13:
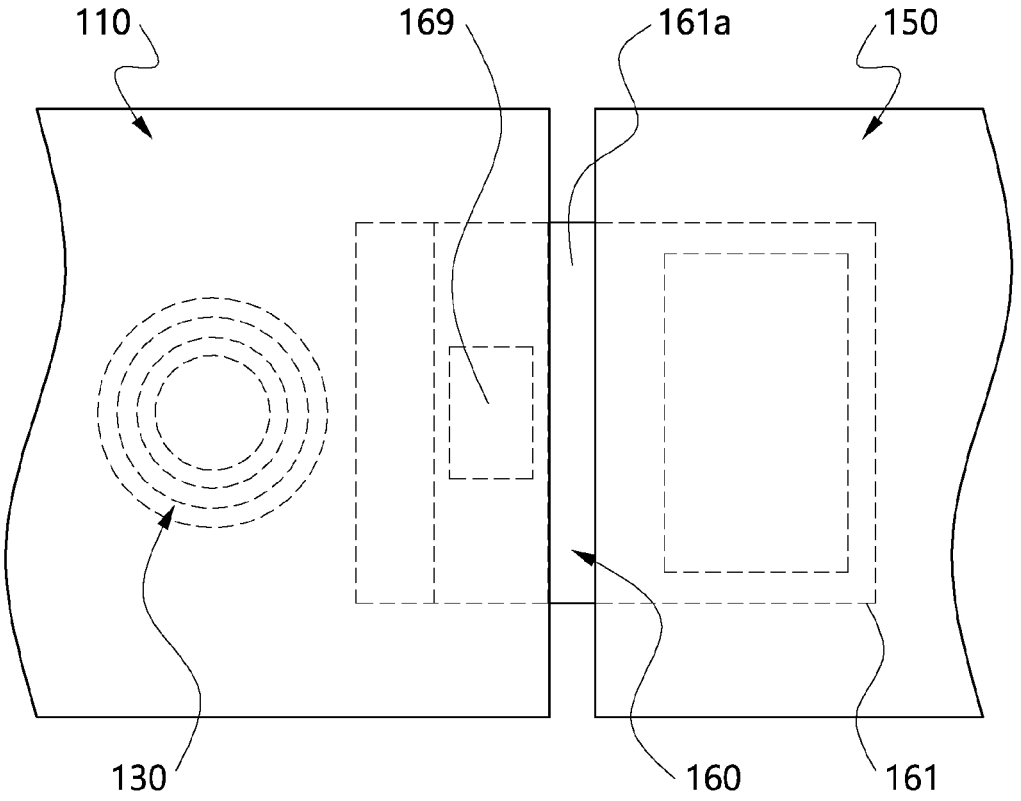
FIG. 13 is a plan view of the connecting mechanism illustrated in FIG. 12.

FIG. 12 is a sectional view illustrating another modification of the connecting mechanism, and FIG. 13 is a plan view of the connecting mechanism illustrated in FIG. 12.

In some cases, the connecting mechanism 160 may include a connecting member 161, which is attached to the first finger unit 150 and includes a groove 161*a* formed in the portion disposed below the bridging cover plate 110, and an escape prevention unit 169, which prevents the first finger unit 150 from escaping from the bridging cover plate 110 by being provided on the bridging cover plate 110 and inserted into the groove 161*a*. In addition, the groove 161*a* and the escape prevention unit 169 shall not interfere with each other in the transverse movement within a limited range, so that the groove 161*a* is not necessarily longer than the escape prevention unit 169. The sliding material 163*c* may be provided on the bottom surface of the connecting member 161.

In this case, a second support unit 130 may be installed below the bridging cover plate 110, in which second support unit 130 includes a concave member 133, which is in slide with the top surface of the second structure 20 via the sliding material 133*b* and has a spherical groove 133*a* or a cylindrical groove formed on the top surface thereof, and a convex member 135, which is attached to the bottom surface of the bridging cover plate 110 and has a convex spherical surface 135*a* or a convex cylindrical surface formed on the bottom surface thereof so as to be coupled to the spherical groove 133*a* or the cylindrical groove. The second unit 130 illustrated in FIG. 5 may be used as the second support unit 130.

Figure 14:
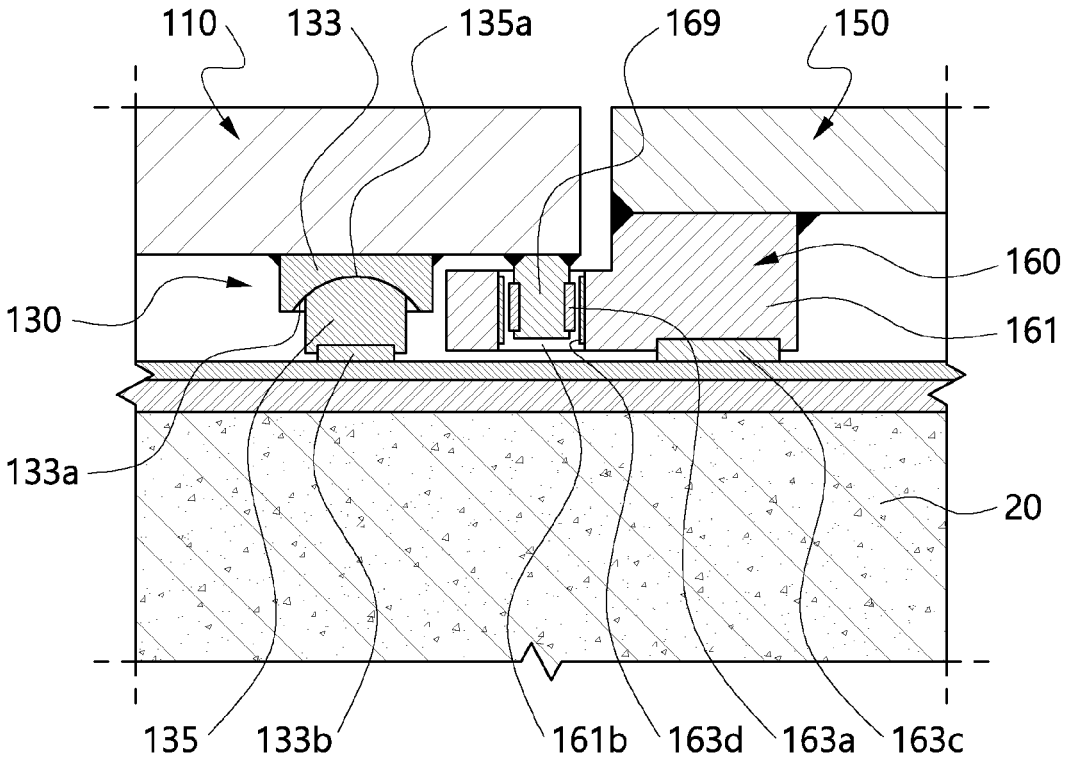
FIG. 14 is a sectional view illustrating a modification of that illustrated in FIG. 12.

FIG. 14 is a sectional view illustrating a modification of that illustrated in FIG. 12.

In some cases, a long hole 161*b* elongated in the width direction may be formed instead of the groove 161*a* in FIG. 12. A sliding material 163*d* such as a stainless-steel plate may be installed on the left and right inner side surfaces of the hole 161*b* and a sliding material 163*a* such as PTFE may be installed on both left and right surfaces of the escape prevention unit 169 inserted into the hole 161*b*. In order to allow leftward or rightward inclination of the escape prevention unit 169 during an earthquake, gaps are provided between the left and right surfaces of the escape prevention unit 169 and the left and right inner peripheral surfaces of the hole 161*b*.

In addition, the second support unit 130 may include a concave member 133, which is installed on the bottom surface of the bridging cover plate 110 over the second structure 20 and has a spherical groove 133*a* or a concave cylindrical surface formed on the bottom surface thereof, and a convex member 135, which is in sliding contact with the second structure 20 through the sliding material 133*b* installed on the bottom surface thereof and has a convex spherical surface 135*a* or a convex cylindrical surface formed on the top surface thereof to be coupled to the spherical groove 133*a* or the concave cylindrical surface.

Figure 15A:
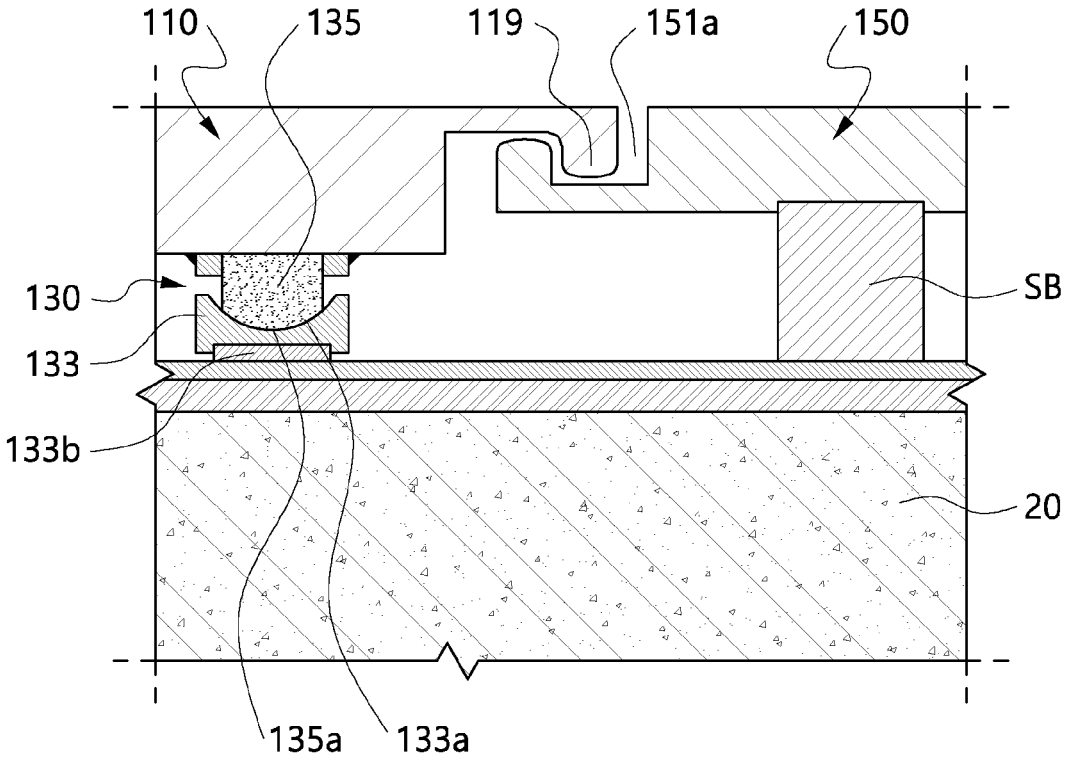
FIGS. 15*a* to 15*c* are views respectively illustrating different examples of the connecting mechanism of the bridging cover plate and the first finger unit.
Figure 15B:
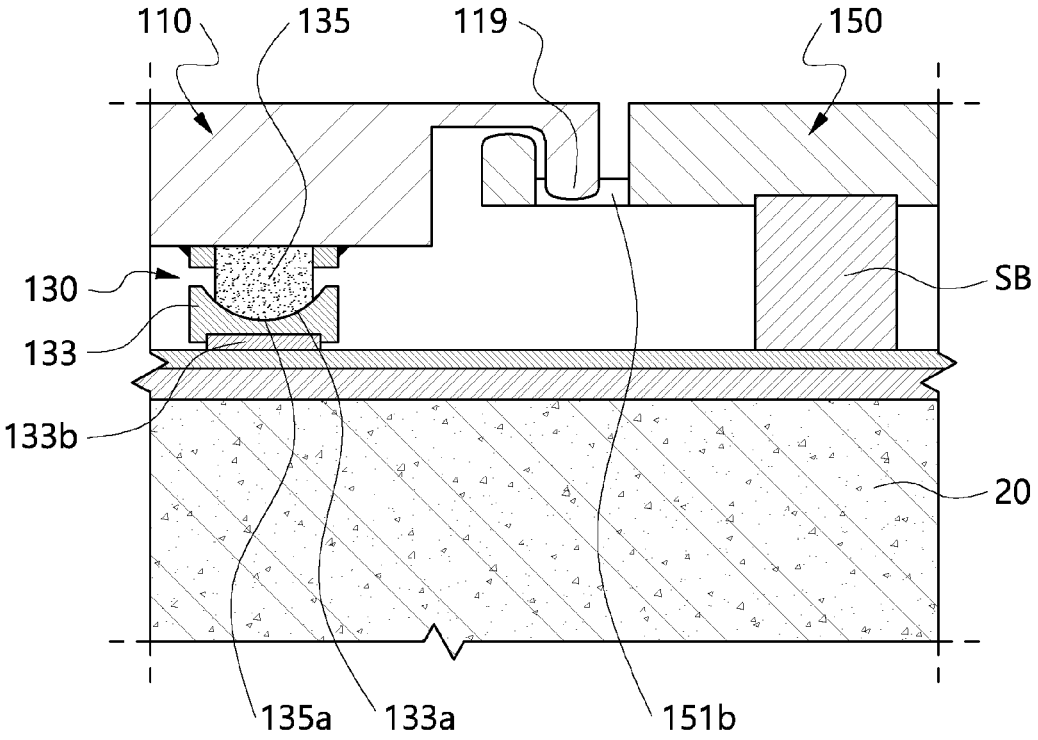
Figure 15C:
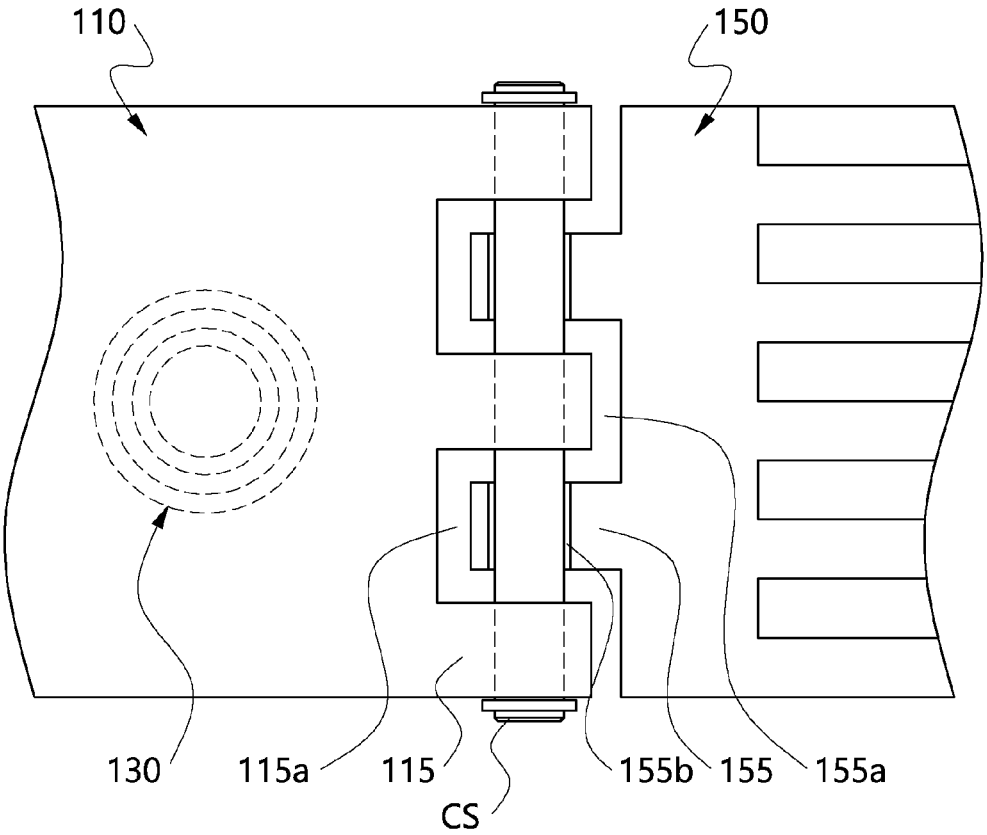

FIGS. 15*a* to 15*c* are views respectively illustrating different examples of the connecting mechanism of the bridging cover plate and the first finger unit.

In some cases, as illustrated in FIGS. 15*a* and 15*b*, a groove 151*a* or a hole 151*b* may be formed in the first finger unit 150 and an escape prevention unit 119 may be provided on the bridging cover plate 110 to be inserted into the groove 151*a* or the hole 151*b* so as to be relatively movable in a transverse direction, so that the first finger unit 150 and the bridging cover plate 110 can be connected to each other so as to be relatively movable in the transverse direction relative to each other. In this embodiment, the groove 151*a* or the hole 151*b* and the escape prevention unit 119 are a kind of connecting mechanism that connects the first finger unit 150 and the bridging cover plate 110 to be relatively movable in the transverse direction relative to each other.

In some cases, as illustrated in FIG. 15*c*, protrusions 115 and 155 and protrusion grooves 115*a* and 155*a* having a larger width than the protrusions 115 and 155 are respectively formed on the facing portions of the first finger unit 150 and the bridging cover plate 110, grooves 155*b*, which are opened upward, are formed in the protrusions 155 of the first finger unit 150 and a connecting shaft CS is installed in the protrusions 115 of the bridging cover plate 110. By coupling the connecting shaft CS to the grooves 155*b*, the first finger unit 150 and the bridging cover plate 110 can be connected to each other such that the first finger unit 150 and the bridging cover plate 110 can make relative movement in the transverse direction relative to each other. In contrast, the connecting shaft CS may be installed in the protrusions 155 of the first finger unit 150 and the downwardly opened grooves to which the connecting shaft CS are coupled may be formed in the protrusions 115 of the bridging cover plate 110.

In this embodiment, the protrusions 115 and 155, the protrusion grooves 115*a* and 155*a*, the connecting shaft CS, the upwardly opened grooves 155*a*, or the downwardly opened grooves may form a connecting mechanism that connects the first finger unit 150 and the bridging cover plate 110 to be relatively movable in the transverse direction relative to each other.

The other features are the same as those described above.

In the case in which the connecting mechanism 160 is formed as described above with reference to FIGS. 10 to 15, when a height difference is generated between the two structures, it is possible to prevent a line contact portion from being generated between the finger joint and the structures, and it is also possible to allow transverse displacement between the two structures.

The finger joint according to the present invention allows movement in various directions between two structures, which are installed in a curved bridge or a skew bridge and disposed to be spaced apart from each other. In addition, it is possible to prevent finger joint components from being damaged by allowing the two structures, which are disposed to be spaced apart from each other, to move in all directions of front, back, up, down, left, and right during an earthquake, and it is possible to prevent problems from occurring in vehicle passage even after the earthquake.

INDUSTRIAL APPLICABILITY

The present invention may be used for making a finger joint, which is installed between two structures, in which a gap between the two structures changes as the structures are expanded or contracted due to temperature change, drying shrinkage, creep, etc., or as the two structures are moved due to an earthquake, a dynamic load applied due to vehicle passage, etc., so that vehicles can pass over the gap without causing rattling.

The invention claimed is:

1. A finger joint installed between a first structure and a second structure, which are disposed with a gap therebetween, a distance of which changes as the first structure and the second structure are expanded or contracted due to temperature change or the like or as the first structure and the second structure are moved by an earthquake or the like, so as to enable a vehicle to smoothly pass over the gap, the finger joint comprising:

a bridging cover plate installed on the first structure and supported to the second structure across the gap so as to support a load of a vehicle passing over the gap, and configured to allow relative movement between the first structure and the second structure in a direction in which the distance of the gap changes;

a first finger unit including a plurality of first fingers connected to the bridging cover plate and supported by the second structure, and a plurality of first finger grooves each formed between neighboring the first fingers; and a second finger unit including a plurality of second fingers configured to be inserted into the first finger grooves, respectively, and a plurality of second finger grooves each formed between neighboring the second fingers, the second finger unit being installed on the second structure so as to allow relative movement relative to the first finger unit in a direction in which the distance of the gap changes, a first support unit installed on the first structure and configured to support a bottom surface of the bridging cover plate on the first structure to be floated from a floor of the first structure;

a second support unit installed on the second structure and configured to support the bottom surface of the bridging cover plate on the second structure to be floated from a floor of the second structure, the second support unit being in sliding contact with the second structure; and an elastic pressing mechanism installed on the first structure between the first support unit and the second support unit or on a protrusion structure protruding from the first structure toward the second structure, and configured to elastically press the bridging cover plate downward.

2. The finger joint of claim 1, wherein the first support unit comprises:

a groove member installed on a top surface of the first structure or the bottom surface of the bridging cover plate, and having a spherical groove or a cylindrical groove; and a convex member installed on any one of the top surface of the first structure and the bottom surface of the bridging cover plate where the groove member is not installed, and having a convex spherical surface or a convex cylindrical surface coupled to the spherical groove or the cylindrical groove so as to allow the bridging cover plate to pivot up and down.

3. The finger joint of claim 1, wherein the spherical groove or the cylindrical groove is formed on the bottom surface of the bridging cover plate over the second structure, and the second support unit comprises a block having a convex spherical surface or a convex cylindrical surface formed on a top surface thereof so as to be coupled to the spherical groove or the cylindrical groove, and a bottom surface formed as a flat surface.

4. The finger joint of claim 1, further comprising:

a support block installed on a bottom surface of the first fingers over the second structure, and configured to support the first fingers on the second structure and to be in sliding contact with the second structure.

5. The finger joint of claim 1, wherein the first finger unit is coupled to the bridging cover plate through a connecting mechanism, and the connecting mechanism comprises:

a connecting member coupled to the first finger unit and having a hole formed in a portion disposed below the bridging cover plate;

a sliding material installed on a bottom surface of the connecting member and configured to be in sliding contact with the second structure;

an elastic support installed between the connecting member and the bridging cover plate; and a connecting body coupled to the bridging cover plate and having an end portion penetrating the elastic support and inserted into the hole.

6. The finger joint of claim 1, wherein the first finger unit is coupled to the bridging cover plate through a connecting mechanism, and the connecting mechanism comprises:

a connecting member having a hole formed in a portion disposed below the bridging cover plate and coupled to the first finger;

a convex member provided at one of a bottom surface of the bridging cover plate and a position of being inserted into the hole to be in sliding contact with the second structure and having a convex spherical surface or a convex cylindrical surface; and a concave member provided at a remaining one of the bottom surface of the bridging cover plate and the position of being inserted into the hole to be in sliding contact with the second structure and having a concave spherical surface or a concave cylindrical surface coupled to the convex spherical surface or the convex cylindrical surface.

7. The finger joint of claim 5, wherein the first finger unit is disposed to be spaced apart from the bridging cover plate, and a filling material is filled between the bridging cover plate and the first finger unit, so that the first finger unit and the bridging cover plate allow a pivoting operation therebetween.

8. The finger joint of claim 1, wherein the first finger unit is integrally formed at an end portion of the bridging cover plate.

9. The finger joint of claim 1, wherein the second finger unit is fixed to the second structure via a fixing mechanism in the state of being supported through a metal block.

10. The finger joint of claim 1, further comprising: a base plate installed on each of the first structure and the second structure, wherein a stainless-steel plate is installed on the base plate of the second structure.

11. The finger joint of claim 1, further comprising: a slide support block installed on the second structure, and configured to support the first finger and to be in sliding contact with the bottom surface of the first finger.

12. The finger joint of claim 6, wherein the hole is formed to be longer than one of the convex member and the concave member, which is inserted into the hole, in a transverse direction perpendicular to a longitudinal direction of a bridge in which the distance of the gap is changed, so as to allow transverse movement of the first finger unit with respect to the bridging cover plate.

13. The finger joint of claim 1, wherein the first finger unit is coupled to the bridging cover plate through a connecting mechanism, and the connecting mechanism comprises:

a connecting member having a hole or a groove formed in a portion disposed under the bridging cover plate and coupled to the first finger unit; and an escape prevention unit installed on the bridging cover plate and inserted into the hole or the groove so as to prevent the first finger unit from escaping from the bridging cover plate, the escape prevention unit being installed to be relatively movable in a transverse direction perpendicular to a longitudinal direction of a bridge which is a direction in which a distance of the gap changes.

14. The finger joint of claim 1, wherein the second support unit comprises:

a convex member provided at one of a bottom surface of the bridging cover plate over the second structure and a position where the convex member is in sliding contact with the second structure and having a convex spherical surface or a convex cylindrical surface; and a concave member provided at a remaining one of the bottom surface of the bridging cover plate over the second structure and a position where the concave member is in sliding contact with the second structure and having a spherical groove or a concave cylindrical surface coupled to the convex spherical surface or the convex cylindrical surface.

15. The finger joint of claim 1, wherein the first finger unit is installed on the bridging cover plate through a connecting mechanism to be relatively movable in a transverse direction perpendicular to a longitudinal direction of a bridge, which is a direction in which the distance of the gap is changed.

16. The finger joint of claim 6, wherein the first finger unit is disposed to be spaced apart from the bridging cover plate, and a filling material is filled between the bridging cover plate and the first finger unit, so that the first finger unit and the bridging cover plate allow a pivoting operation therebetween.

17. The finger joint of claim 1, further comprising: a base plate installed on each of the first structure and the second structure, wherein a stainless-steel plate is installed on the base plate of the second structure.

18. The finger joint of claim 3, further comprising: a base plate installed on each of the first structure and the second structure, wherein a stainless-steel plate is installed on the base plate of the second structure.

19. The finger joint of claim 4, further comprising: a base plate installed on each of the first structure and the second structure, wherein a stainless-steel plate is installed on the base plate of the second structure.

* * * * *